US011161570B1

(12) United States Patent
Zhang et al.

(10) Patent No.: US 11,161,570 B1
(45) Date of Patent: Nov. 2, 2021

(54) CABLE-DIRECTION-ADAPTIVE ROV WINCH APPLIED TO NON-DYNAMIC-POSITIONING-EQUIPPED MOTHERSHIPS

(71) Applicant: GUANGZHOU BUREAU, CSG EHV POWER TRANSMISSION COMPANY, Guangzhou (CN)

(72) Inventors: Weijia Zhang, Guangzhou (CN); Xiaowei Huang, Guangzhou (CN); Zhenjin Cen, Guangzhou (CN); Cong Wu, Guangzhou (CN); Chi Cai, Guangzhou (CN); Yikang Chen, Guangzhou (CN); Xiaojun Li, Guangzhou (CN); Qiang Guo, Guangzhou (CN); Jianying Wang, Guangzhou (CN); Hangwei Chen, Guangzhou (CN); Cheng Chen, Guangzhou (CN); Man Zhang, Guangzhou (CN); Jun Chen, Guangzhou (CN); Fang He, Guangzhou (CN); Guang Ji, Guangzhou (CN); Gang Zhao, Guangzhou (CN); Zheng Chen, Guangzhou (CN); Qingshuai Wu, Guangzhou (CN); Yang Zhu, Guangzhou (CN); Fang Liu, Guangzhou (CN); Hai Lu, Guangzhou (CN); Yong Cai, Guangzhou (CN); Wulue Zheng, Guangzhou (CN)

(73) Assignee: GUANGZHOU BUREAU, CSG EHV POWER TRANSMISSION COMPANY, Guangzhou (CN)

( * ) Notice: Subject to any disclaimer, the term of this patent is extended or adjusted under 35 U.S.C. 154(b) by 341 days.

(21) Appl. No.: 16/481,076

(22) PCT Filed: Nov. 12, 2018

(86) PCT No.: PCT/CN2018/115092
§ 371 (c)(1),
(2) Date: Jul. 26, 2019

(87) PCT Pub. No.: WO2020/034460
PCT Pub. Date: Feb. 20, 2020

(30) Foreign Application Priority Data

Aug. 14, 2018 (CN) ..... 201810923141.9

(51) Int. Cl.
*B63B 21/66* (2006.01)
*B63G 8/00* (2006.01)

(52) U.S. Cl.
CPC ..... *B63B 21/66* (2013.01); *B63G 8/001* (2013.01); *B63G 2008/007* (2013.01)

(58) Field of Classification Search
CPC ..... B63B 21/00; B63B 21/66; B63G 8/00; B63G 8/001; B63G 2008/007; B63C 11/00; B63C 11/34; B63C 7/00; B63C 7/16
(Continued)

(56) References Cited

U.S. PATENT DOCUMENTS 3,871,527 A * 3/1975 Schimmeyer ..... B66C 13/02 212/308
4,021,019 A * 5/1977 Sanders ..... B63B 27/10 414/137.7
(Continued)

FOREIGN PATENT DOCUMENTS

CN 204916127 U 12/2015
CN 106476994 A 3/2017
(Continued)

*Primary Examiner* — Lars A Olson

(74) *Attorney, Agent, or Firm* — Bayramoglu Law Offices LLC

(57) ABSTRACT

A cable-direction-adaptive ROV winch applied to non-DP-equipped motherships, includes a non-DP-equipped mothership, an A-shaped support and a winch cable-drawing roller provided on the non-DP-equipped mothership, and an underwater vehicle. A pulley is rotatably connected to the A-shaped support, the underwater vehicle is connected to an umbilical cable, the umbilical cable passes around the pulley to be connected to the winch cable-drawing roller, and a locating unit for guiding the umbilical cable is provided on the non-DP-equipped mothership. The A-shaped support is provided with a rod. The pulley includes a sliding section and a rotating section, and the sliding section is annular and slides on the rod along a direction of the rod. The rod has a groove, and a bulge portion is formed on the sliding section. The rotating section is rotatably connected to an outer circle of the sliding section via a shaft bearing.

7 Claims, 2 Drawing Sheets

(58) Field of Classification Search
USPC ..... 114/244, 312
See application file for complete search history.

(56) References Cited

U.S. PATENT DOCUMENTS

| | | | | |
|---|---|---|---|---|
| 5,140,927 A * | 8/1992 | Tolefson | ..... | B63B 39/02 114/312 |
| 9,540,076 B1 * | 1/2017 | Trail | ..... | B63B 27/08 |
| 9,855,999 B1 * | 1/2018 | Trail | ..... | B63B 27/08 |
| 10,328,999 B2 * | 6/2019 | Trail | ..... | B63G 8/001 |

FOREIGN PATENT DOCUMENTS

| | | |
|---|---|---|
| CN | 107351999 A | 11/2017 |
| CN | 107628565 A | 1/2018 |
| CN | 207175114 U | 4/2018 |
| JP | 2000085685 A | 3/2000 |
| SU | 600021 A1 | 3/1978 |

* cited by examiner

A

CABLE-DIRECTION-ADAPTIVE ROV WINCH APPLIED TO NON-DYNAMIC-POSITIONING-EQUIPPED MOTHERSHIPS

CROSS REFERENCE TO THE RELATED APPLICATIONS

This application is the national phase entry of International Application No. PCT/CN2018/115092, filed on Nov. 12, 2018, which is based upon and claims priority to Chinese Patent Application No. 201810923141.9, filed on Aug. 14, 2018, the entire contents of which are incorporated herein by reference.

TECHNICAL FIELD

The present invention relates to the technical field of ROV winch devices, and particularly relates to a cable-direction-adaptive ROV winch applied to non-dynamic-positioning-equipped motherships.

BACKGROUND

At present, a remotely operated underwater vehicle (ROV) is carried by a dynamic-positioning-equipped mothership during an underwater operation. The DP-equipped mothership uses its own propulsion devices to maintain the ship's position so as to be coordinated with the operation of the underwater vehicle. However, DP-equipped motherships have disadvantages such as the high construction cost, the tight schedule, and the high renting and operating cost.

Non-dynamic-positioning-equipped motherships are widely used and have low construction and renting costs, and there are more ships and types to choose from in the market which makes their application more flexible. However, since they are mostly maintaining their position by anchoring, they will be largely affected by winds, waves, surges and flows, and their position will change significantly. If an ROV is carried by a non-DP-equipped mothership, its operation will be restricted by the positioning of the mothership and its connection to the ROV umbilical cable, and thereby the operation cannot be carried out well.

In order to allow the ROV carried by a non-DP-equipped mothership to operate, it is necessary to develop the ROV winch on the mothership to reduce the risk that the umbilical cable could break due to the excessive force on the cable generated with the swaying of ship.

SUMMARY

In order to solve the problem of the ROV carried by a non-DP-equipped mothership that the ROV umbilical cable will experience a huge pulling force with the ship movement during operation, the present invention provides a cable-direction-adaptive ROV winch applied to non-DP-equipped motherships, which can reduce the impact of ship diversions on the ROV operation efficiency and reduce the risk that the ROV could be lost due to the umbilical cable breakage.

In order to achieve the above object, the technical solution of the present invention is as follows.

A cable-direction-adaptive ROV winch applied to non-DP-equipped motherships, comprising a non-DP-equipped mothership, an A-shaped support and a winch cable-drawing roller which are provided on the non-DP-equipped mothership, and an underwater vehicle. A pulley is rotatably connected to the A-shaped support, the underwater vehicle is connected to an umbilical cable, the umbilical cable passes around the pulley to be connected to the winch cable-drawing roller, and a locating unit for guiding the umbilical cable is provided on the non-DP-equipped mothership. The A-shaped support is provided with a rod. The pulley comprises a sliding section and a rotating section, and the sliding section is annular and slides on the rod along a direction of the rod. The rod has a groove, and a bulge portion is formed on the sliding section. The rotating section is rotatably connected to an outer circle of the sliding section via a shaft bearing.

Further, the rod is in the shape of an arc, and a center of the arc locates at a center of the locating unit.

Further, the locating unit is in the shape of a transverse sandglass, and disposed on a line connecting the umbilical cable and the winch cable-drawing roller when the pulley is located at a middle of the rod, and an angle formed by the sandglass is identical to an angle of the arc.

Further, the sliding section is provided with a driving unit configured to drive the sliding section sliding on the rod.

Further, the driving unit comprises a cogwheel rotatably connected to the sliding section and a cogwheel rail provided on the rod and engaging with the cogwheel, and a remotely-controlled motor is coaxially connected to the cogwheel.

Further, the sliding section is provided with a locking device configured to prevent rotation of the cogwheel.

Further, the locking device comprises a telescopic projecting bar, and the cogwheel has a plurality of holes configured to allow for insertion of the projecting bar.

Compared with the prior art, the present invention has the following advantages.

1) Through the design that the pulley can slide freely on the A-shaped support, in the event that the non-DP-equipped mothership sways with the waves when the underwater vehicle is operated in the sea, the pulley will slide on the A-shaped support following the movement of the mothership, and thereby operation of the underwater vehicle will not be affected by lateral force caused by the swaying of the ship. Since the umbilical cable can follow the sliding pulley, which reduces the occurrence of the cable being stretched when the ship sways, and thereby reduces the risk that the ROV could be lost due to the umbilical cable breakage.

2) As a sandglass-shaped locating unit for guiding the umbilical cable is provided on the mothership, and the rod of the A-shaped support is in the shape of an arc, these configurations allow for the curved sliding of the umbilical cable with the pulley on the A-shaped support along the arc direction of the rod. Since the center of the arc locates at the center of the locating unit, an angle of the umbilical cable sliding will be confined by the sandglass shape of the locating unit such that the angle will not be too large; this configuration also has a guiding effect that prevents the umbilical cable from shifting when it passes around the pulley which causes unsmooth sliding.

3) A cogwheel, a cogwheel rail and a remotely-controlled motor are provided where the pulley and the rod are rotatably connected. With such configurations, when the motor is off, the pulley will slide along the rod with the swaying of the ship; when necessary, the motor may be started up to cause a corresponding sliding of the pulley. Moreover, the pulley can be provided with a locking device that, when necessary, the cogwheel may be locked with the locking device and thereby the cogwheel sliding on the rod is restricted to facilitate the operation.

Reference signs: 1. non-DP-equipped mothership; 2. A-shaped support; 21. rod; 22. groove; 3. underwater vehicle; 4. pulley; 41. rotating section; 42. sliding section; 43. shaft bearing; 44. bulge portion; 5. locating unit; 6. winch cable-drawing roller; 61. umbilical cable; 7. driving unit; 71. cogwheel; 72. cogwheel rail; 73. remotely controlled motor; 8. locking device; 81. projecting bar; 82. hole.

DETAILED DESCRIPTION OF EMBODIMENTS

In order to make the above objects, features and advantages of the present invention more clear and understandable, the present invention will be further described in detail with reference to the accompanying drawings and the following embodiments.

Figure 1:
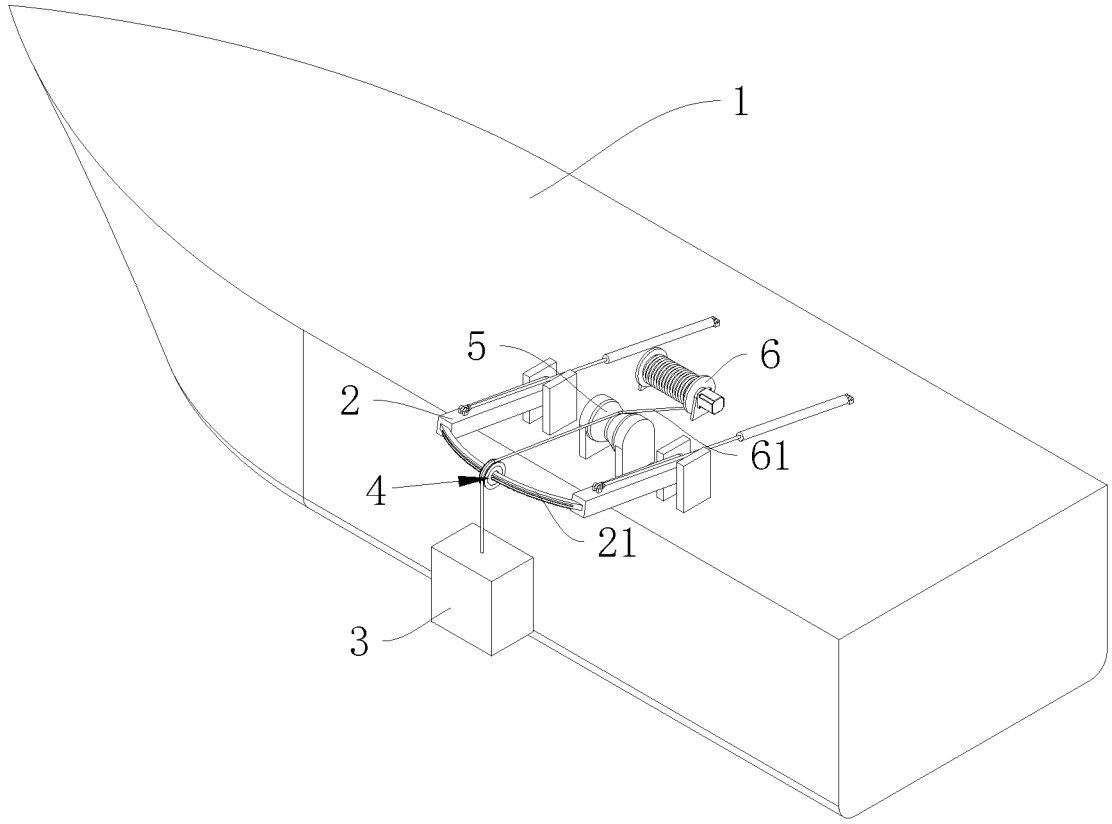
FIG. 1 is a diagram showing the whole structure of a cable-direction-adaptive ROV winch of the present invention applied to non-dynamic-positioning-equipped mothers-hips.

As shown in FIG. 1, a cable-direction-adaptive ROV winch, which is applied to non-DP-equipped motherships, comprises a non-DP-equipped mothership 1, an A-shaped support 2 and a winch cable-drawing roller 6 which are provided on the non-DP-equipped mothership, and an underwater vehicle 3. A pulley 4 is rotatably connected to the A-shaped support 2. A locating unit 5 for guiding an umbilical cable 61 is fixed on the non-DP-equipped mothership 1. The underwater vehicle 3 is connected to the umbilical cable 61, the umbilical cable 61 passes around the pulley 4 and the locating unit 5 to be connected to the winch cable-drawing roller 6. The A-shaped support 2 is provided with a rod 21 at its end, and the pulley 4 can slide freely on the rod 21 along a direction thereof. The rod has a groove, a bulge portion is formed on the sliding section, and the rotating section is rotatably connected to an outer circle of the sliding section via a shaft bearing. A driving unit 7 is provided between the pulley 4 and the rod 21, which makes it possible to adjust the position of the pulley 4 on the rod 21 when necessary.

Figure 2:
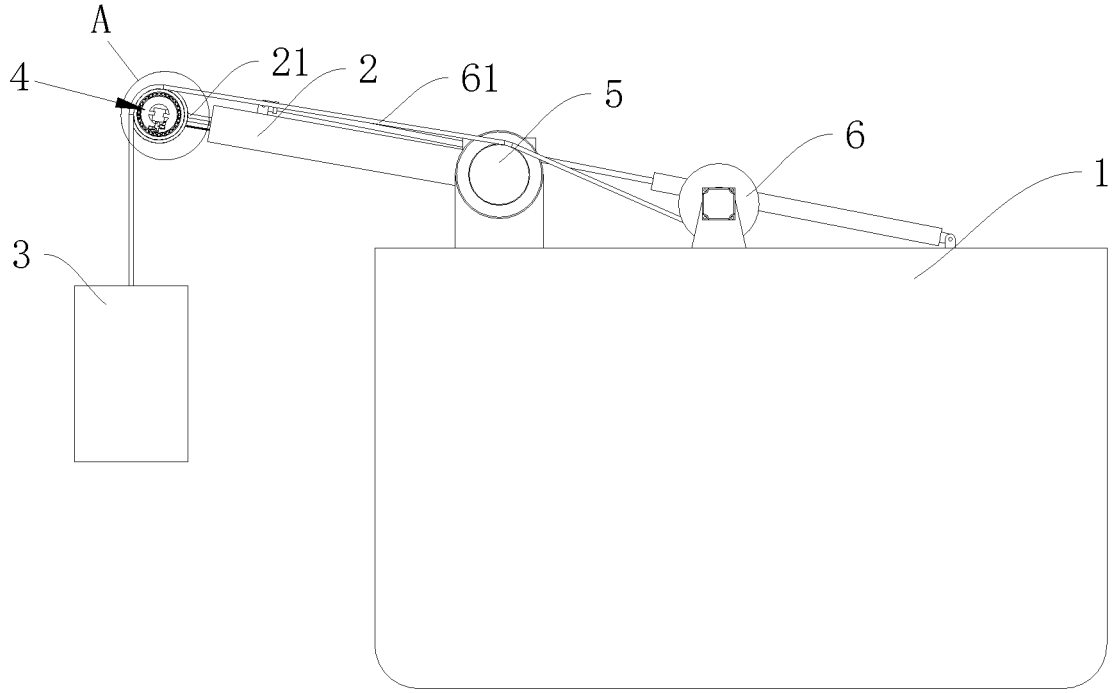
FIG. 2 is a diagram showing a partial internal structure of the cable-direction-adaptive ROV winch of the present invention applied to non-dynamic-positioning-equipped motherships.
Figure 3:
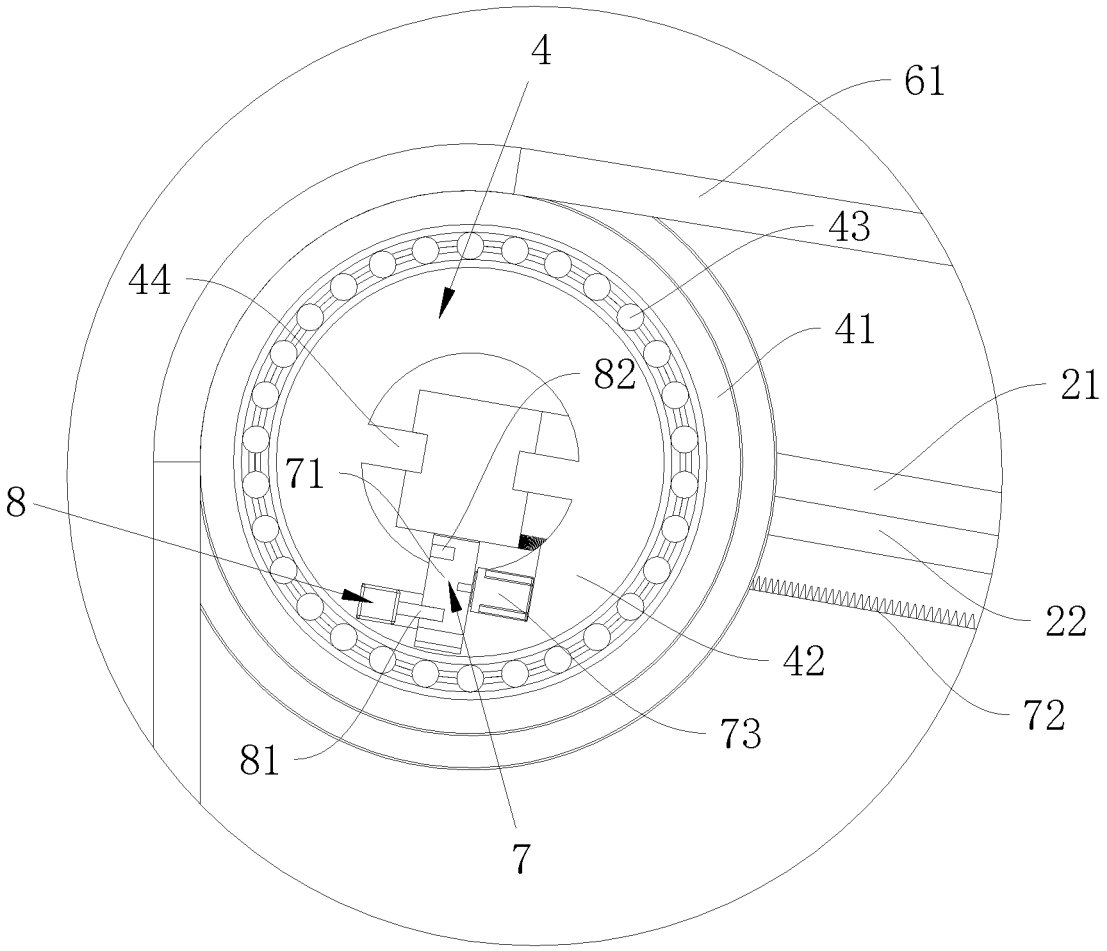
FIG. 3 is an enlarged view of section A in FIG. 2.

As shown in FIG. 2 and FIG. 3, the pulley 4 comprises a sliding section 42 over the rod 21 and a rotating section 41 which is rotatably connected to the sliding section 42 via a shaft bearing 43. Two bulge portions 44 are formed on the sliding section 42, and the rod 21 has two grooves 22 which allow the bulge portions 44 to slide along. The grooves 22 are respectively provided on two lateral surfaces of the rod 21. The driving unit 7 is provided at the interface between the bottom surface of the rod 21 and the sliding section 42. The rotating section 41 is rotatably connected to an outer circle of the sliding section 42 via the shaft bearing 43, and has a groove for winding the umbilical cable 61.

The driving unit 7 comprises a cogwheel rotatably 71, which is connected to the sliding section 42, and a cogwheel rail 72, which is fixed on the bottom surface of the rod 21 and engaging with the cogwheel 71. The cogwheel rail 72 overspread the bottom surface of the rod 21. The sliding section 42 is further provided with a remotely-controlled motor 73 for driving the rotation of the cogwheel 71. The remotely-controlled motor 73 is not self-locking when powered off, such that the pulley 4 can be free to slide along the rod 21 with the swaying of the ship when powered off. Further, a locking device 8, which is configured to prevent rotation of the cogwheel 71, is fixed to the sliding section 42. The locking device 8 has a telescopic projecting bar 81, and the cogwheel 71 has a plurality of holes 82 into which the projecting bar 81 can be inserted for locking. With such configurations, when the locking device 8 is remotely switched on, the cogwheel 71 is restricted and thereby unable to rotate freely; by combining these configurations with the cogwheel 71 and the cogwheel rail 72, it is possible to restrict the free sliding of the pulley 4.

As shown in FIG. 1, the locating unit 5 is in the shape of a transverse sandglass, and fixed on a line connecting the umbilical cable 61 and the winch cable-drawing roller 6 when the pulley 4 is located at the middle of the rod 21. The rod 21 is in the shape of an arc, and a center of the arc locates at a center of the locating unit 5. An angle formed by the sandglass is identical to an angle of the arc of the rod 21. With the above configuration of the locating unit 5, when the pulley 4 is sliding with the swaying of the ship, since the center of sliding of the pulley 4 locates at the center of the locating unit 5, the umbilical cable 61 can always be in the same direction as the pulley 4. With the configuration that the angle formed by the sandglass of the locating unit 5 is identical to the angle of the arc of the rod 21, it is possible to prevent a large-angle sliding of the pulley 4 with the locating unit 5.

In practice, when the non-DP-equipped mothership 1 is anchored in the sea and the underwater vehicle 3 is sent out for operation, it is very likely that the ship may not be well positioned and will sway with a smash of the waves. In such case, the rotative relationship between the pulley 4 and the rod 21 of the A-shaped support 2 can largely reduce the influence of the ship swaying on the underwater vehicle 3 and the umbilical cable 61. When the pulley 4 is sliding on the rod 21, since the locating unit 5 has a guiding effect and can restrict the sliding angle such that the umbilical cable 61 can always be in the same direction as the pulley 4, there will be no occurrence of unsmooth sliding of the umbilical cable 61 when it passes around the pulley 4.

When necessary, the remotely-controlled motor 31 may be switched on for controlling the cogwheel 71 on the pulley 4, and thus the cogwheel 4 will slide to the desired location on the rod 21 as required. When it is time to recover, generally the pulley 4 will be slide to the middle of the rod 21 under the control of the remotely-controlled motor 73, such that the pulley 4, the locating unit 5 and the winch cable-drawing roller 6 are in the same line. Then the locking device is switched on to lock the cogwheel 71 so as to restrict the sliding of the pulley 4. Afterwards, the underwater vehicle 3 can be recovered by controlling the winch cable-drawing roller 6.

The device can be applied to a non-DP-equipped mothership 1 or a mothership without any dynamic positioning system when budget is limited, in order to reduce the cost on the ship.

The above embodiments are only intended to illustrate the technical concept and the features of the present invention, in order to enable those skilled in the art to understand the contents of the present invention and to implement the present invention. Equivalent changes or modifications made in accordance with the spirit of the invention are intended to be included within the scope of the invention.

What is claimed is:

1. A cable-direction-adaptive ROV winch applied to non-dynamic-positioning-equipped motherships, comprising: a non-dynamic-positioning-equipped mothership, an A-shaped support and a winch cable-drawing roller provided on the non-dynamic-positioning-equipped mothership, and an underwater vehicle, wherein a pulley is rotatably connected to the A-shaped support, the underwater vehicle is connected to an umbilical cable, and the umbilical cable passes around the pulley to be connected to the winch cable-drawing roller;

a locating unit for guiding the umbilical cable is provided on the non-dynamic-positioning-equipped mothership; the A-shaped support is provided with a rod; the pulley comprises a sliding section and a rotating section, and the sliding section is annular and slides on the rod along a direction of the rod; the rod has a groove, and a bulge portion is formed on the sliding section; the rotating section is rotatably connected to an outer circle of the sliding section via a shaft bearing.

2. The cable-direction-adaptive ROV winch according to claim 1, wherein, the rod is in a shape of an arc, and a center of the arc locates at a center of the locating unit.

3. The cable-direction-adaptive ROV winch according to claim 2, wherein, the locating unit is in a shape of a transverse sandglass and disposed on a line connecting the umbilical cable and the winch cable-drawing roller when the pulley is located at a middle of the rod, and an angle formed by the sandglass of the locating unit is equal to an angle of the arc of the rod.

4. The cable-direction-adaptive ROV winch according to claim 1, wherein, the sliding section is provided with a driving unit for driving the sliding section sliding on the rod.

5. The cable-direction-adaptive ROV winch according to claim 4, wherein, the driving unit comprises a cogwheel rotatably connected to the sliding section and a cogwheel rail provided on the rod and engaging with the cogwheel; a remotely-controlled motor is coaxially connected to the cogwheel.

6. The cable-direction-adaptive ROV winch according to claim 5, wherein, the sliding section is provided with a locking device for preventing rotation of the cogwheel.

7. The cable-direction-adaptive ROV winch according to claim 6, wherein, the locking device comprises a telescopic projecting bar, and the cogwheel has a plurality of holes configured to allow for insertion of the projecting bar.

* * * * *